US005845363A

United States Patent [19]

Brempell et al.

[11] Patent Number: 5,845,363

[45] Date of Patent: Dec. 8, 1998

[54] ADJUSTABLE ROLLER ASSEMBLY

[75] Inventors: Maitland J. Brempell, Rice Lake; Laurence P. Armstrong, Weyerhaeuser, both of Wis.; Petros Z. Mantarakis, Sun Valley, Calif.

[73] Assignee: Quanex Corporation, Rice Lake, Wis.

[21] Appl. No.: 861,854

[22] Filed: May 22, 1997

[51] Int. Cl.[6] ..... A47H 15/00

[52] U.S. Cl. ..... 16/105; 16/99; 280/43.21

[58] Field of Search ..... 16/105, 106, 107, 16/91, 99, 97, 32, 33, 34, 44; 280/43.14, 43.17, 43.21, 43.24, 37, 47.26, 63; 160/105; 49/425, 420, 410

[56] References Cited

U.S. PATENT DOCUMENTS

| | | | |
|---|---|---|---|
| 2,940,113 | 6/1960 | Riser | 16/105 |
| 2,990,567 | 7/1961 | Pearson | 16/105 |
| 3,237,238 | 3/1966 | Anderson | 16/105 |
| 3,698,036 | 10/1972 | Goodman | 16/100 |
| 3,959,849 | 6/1976 | Marquardt | 16/105 |
| 4,006,513 | 2/1977 | Offterdinger | 16/105 |
| 4,134,178 | 1/1979 | Stevens | 16/100 |
| 4,404,771 | 9/1983 | Murase et al. | 49/425 |
| 4,805,262 | 2/1989 | Marshik | 16/105 |
| 4,850,078 | 7/1989 | Libby et al. | 16/100 |
| 4,873,741 | 10/1989 | Riegelman | 16/105 |
| 5,161,330 | 11/1992 | Auriemma | 49/420 |
| 5,343,594 | 9/1994 | Harvey | 16/105 |

*Primary Examiner*—Chuck Mah
*Attorney, Agent, or Firm*—Lee, Mann, Smith, McWilliams, Sweeney & Ohlson

[57] ABSTRACT

An adjustable roller assembly for sliding doors including a housing adapted to be snap-fit into a recess provided in the upper or lower surface of a door frame, the housing defining a cavity which is open at the lower end. A roller carrier is mounted in the housing cavity and is vertically biased outwardly by one or more coil springs. Rotatably mounted within the roller carrier is a roller adopted to travel along a track. A base plate is disposed within the housing and is connected to a rack member. The rack member is provided with teeth which engage and cooperate with the gear teeth of an adjustment gear extending laterally through both sides of the housing. An engagement slot, adapted to receive a screwdriver or similar tool, is provided in at least one end of the adjustment gear. Vertical adjustment of the base plate may be achieved by rotating the adjustment gear, which vertically moves the rack member and its connected base plate. The position of the base plate within the housing limits the upward vertical movement of the roller carrier and roller. In the lower position, the base plate is located so as to virtually eliminate any travel or upward movement of the roller carrier and roller. In the upper position, the location of the base plate allows for maximum travel of the roller carrier and roller. The roller assembly can be adjusted after the sliding door is positioned on the track to eliminate or reduce slack and prevent door derailment.

14 Claims, 2 Drawing Sheets

ADJUSTABLE ROLLER ASSEMBLY

BACKGROUND OF THE INVENTION

The present invention provides an adjustable roller assembly for doors which slide on tracks. Such doors can include screens or panes of glass or other panels. The adjustment mechanism can be used to take up slack after the door is installed on a track. Numerous arrangements of this general type are shown in U.S. Pat. Nos. 2,940,113, 3,698,036, 3,959,849, 4,134,178, 4,404,771, 4,805,262, 4,850,078, 4,873,741, 5,161,330, and 5,343,594. None of these patents discloses the features of the present invention.

The doors described are usually fabricated from lightweight materials, such as aluminum, so that they will be easy to roll back and forth during the opening and closing process. While the lightness of the doors greatly facilitates their ease of use, unfortunately, their lack of weight provides certain inherent disadvantages. One of these is the tendency of the door rollers to become disengaged from their track. This tendency to derail is caused by a variety of factors including, for example, variations in clearance between the track and the door, resulting from clearance faults between the door and the opening in which it is located; from the tendency of individuals to lift up on the doors when operating them, as well as for various other reasons. Irrespective of the cause for derailment, whenever the doors are disengaged from their tracks, they immediately become inoperable and must be reinstalled, frequently a difficult task.

In the past, a number of solutions have been proposed to solve the problem described, particularly including the use of spring-loaded rollers which force the rollers into firm engagement with their tracks. Oftentimes, however, the spring-loaded rollers have been undesirably complicated and have proven to be expensive and difficult to make and install in the course of the doors manufacture. Furthermore, the load-carrying capacity of such rollers has frequently been inferior as well.

Still another problem has been adjustment of the spring, required to provide a proper engaging force between the track and the rollers associated with it. Generally, such force can be suitably increased or decreased by means of adjusting screws forming part of the roller assembly. However, the mechanics of the assemblies have typically required that the adjusting screws be located in positions in which they are not readily accessible, making the adjustment process difficult.

To overcome the problems in the prior art, the present invention provides a door roller assembly that is quickly and easily installed in a sliding door and is relatively simple and inexpensive to construct.

SUMMARY OF THE INVENTION

The present invention provides an adjustable roller assembly for sliding doors. The assembly includes a housing adapted to be mounted in a recess provided at the upper or lower edge of a sliding door. The housing may be rotatably snap-fit into the slot in the door edge. The housing defines a cavity therein which is open at the lower end thereof. A roller carrier is mounted in the cavity and is movably adjustable with respect to the housing. The roller carrier defines one or more apertures at its upper end to cooperate with one or more projections extending inwardly from the housing so as to provide a means for retaining the roller carrier in a compressed position for shipping purposes. A roller is rotatably mounted in the roller carrier. One or more coil springs are disposed between the housing and the roller carrier so as to bias the roller carrier to an outwardly extending position. Also disposed within the housing is a base plate which is connected to a rack member. The base plate defines an aperture through which the coil springs pass. The rack member is provided with teeth which engage and cooperate with the gear teeth of an adjustment gear extending through both sides of the housing. A slot adapted to receive a screwdriver or similar tool is provided in at least one end face of the adjustment gear. Vertical adjustment of the base plate with respect to the housing may be achieved by rotating the adjustment gear, which vertically moves the rack member and its connected base plate between upper and lower positions which controls the upper limit of vertical movement of the base plate. In the lower most position, the base plate is located so as to virtually eliminate any travel of the roller carrier and roller. In the uppermost position, the location of the base plate allows for maximum travel of the roller carrier and roller.

BRIEF DESCRIPTION OF THE INVENTION

DETAILED DESCRIPTION OF THE DRAWINGS

Figure 1:
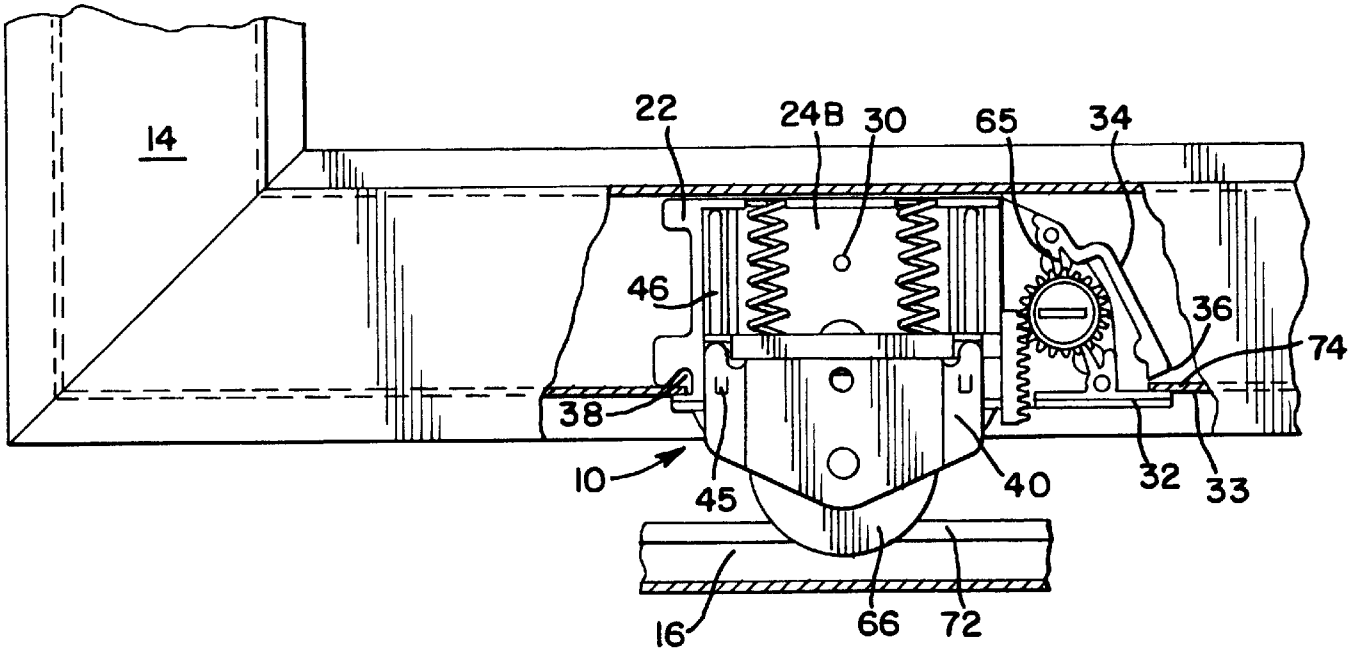
FIG. 1 is a front view, partially broken away, with the front portion of the housing removed, of the roller assembly of the present invention installed in a door frame with the base plate lowered vertically with respect to the assembly housing.

FIG. 1 illustrates an adjustable roller assembly, generally designated by the numeral 10, mounted in a recess or slot provided in a lower edge of a door frame 14 for sliding on a track 16 positioned below and extending beyond the width of the door frame 14.

Figure 2:
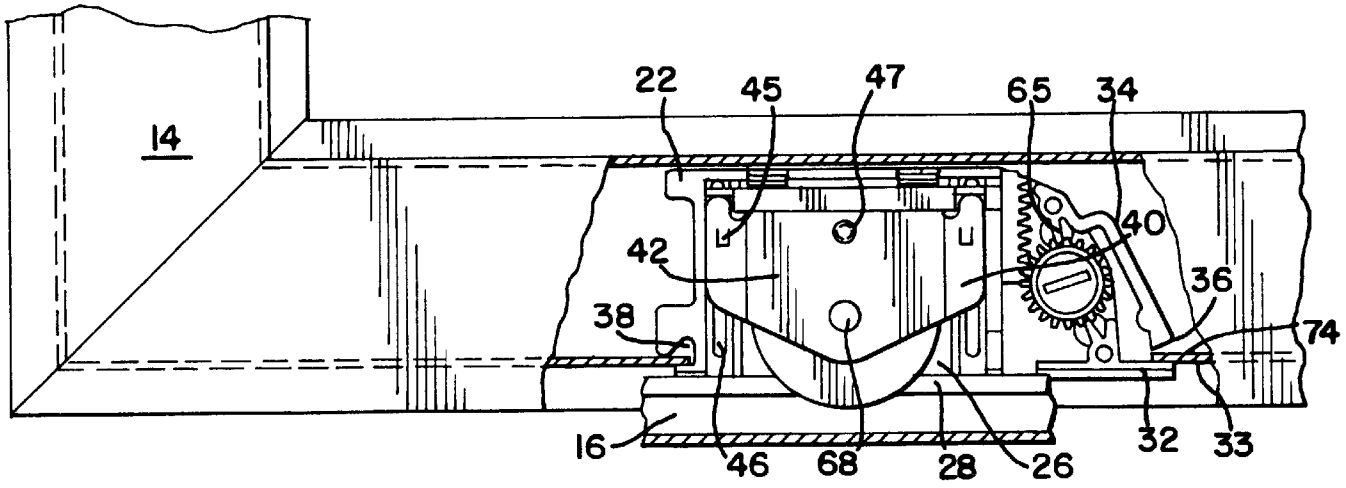
FIG. 2 is a front view, partially broken away, of the roller assembly shown in FIG. 1 with the base plate raised vertically with respect to the assembly housing.
Figure 3:
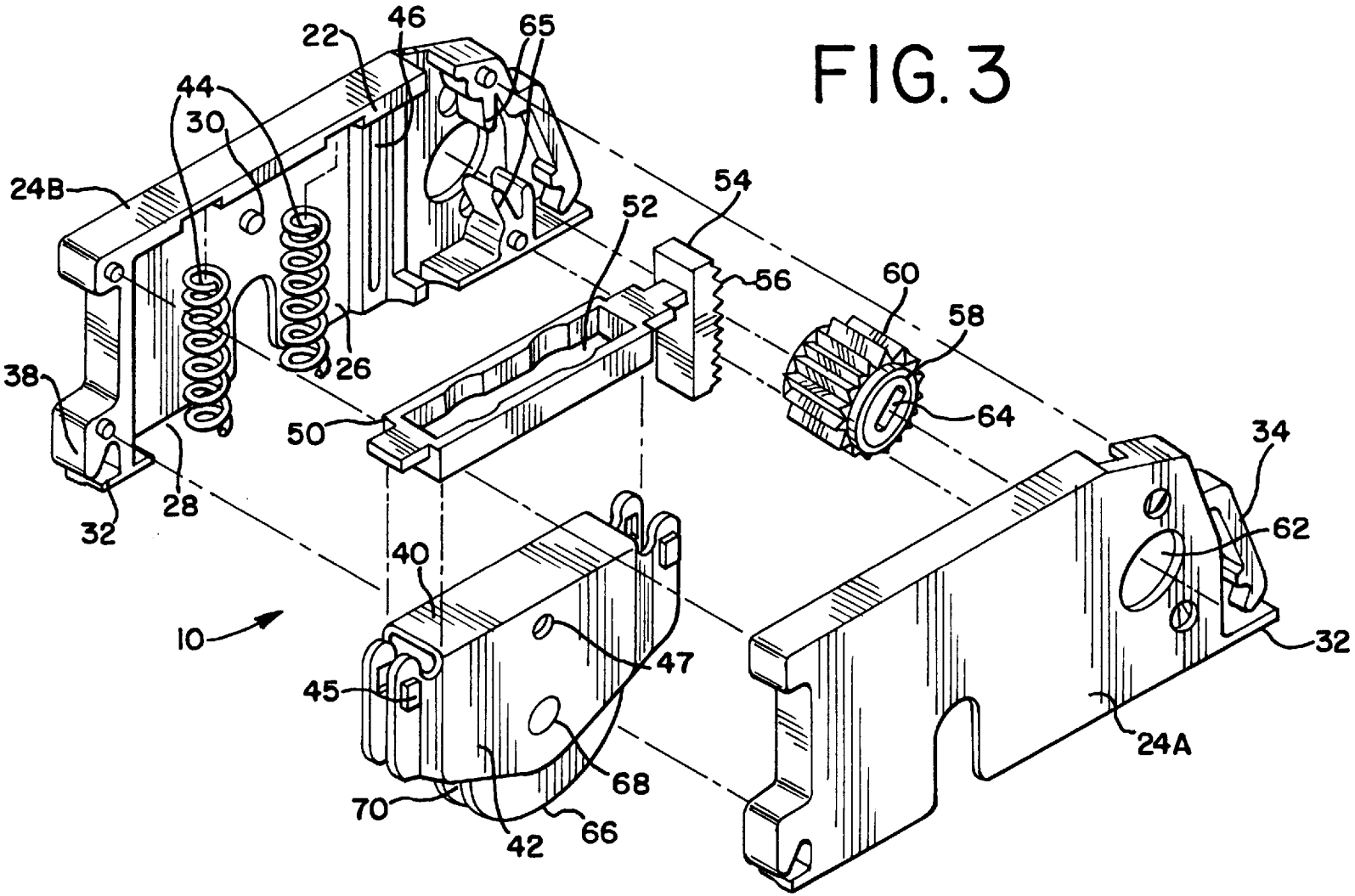
FIG. 3 is an exploded perspective view of the roller assembly of the present invention.

As best shown in FIG. 3, the roller assembly 10 includes a housing 22 comprising a pair of opposing corresponding walls 24 A and B joined together in any appropriate manner, as for example, snap-fit. In FIG. 3, both housing side walls 24 A and B are shown, but in FIGS. 1 and 2 the front side wall 24 A has been removed to show the positions of the inner components of the roller assembly 10. The housing 22 defines a cavity 26 therein and has an opening 28 at the lower end thereof. An inwardly extending projection 30 is located at the upper end of each side wall 24 A and B, the significance of which will become apparent. The lower end of each side wall 24 A and B is provided with an outwardly laterally extending flange 32 which is disposed adjacent to and in contact with the outer lower surface 33 of the door frame 14 when the assembly 10 is installed. Extending from one end of each side wall 24 A and B is a resilient locking member 34 which functions as a locking means and enables the housing 22 to be releasably locked into the door frame recess. The locking member 34 is integral to the side walls 24 A and B and has a free end with an abutment surface 36. At the other end of each side wall 24 A and B is a hook-notch 38 located at the lower end thereof.

A roller carrier 40 is mounted in the cavity 26 for vertical movement with respect to the housing 22. The roller carrier 40 consists of a pair of downwardly extending arcuate-shaped flanges 42, each of which is disposed adjacent the inner side of the housing side walls 24 A and B. One or more coil springs 44 act as resilient biasing means and are disposed within the upper surface of the housing 22 and compressed between the housing 22 and the upper surface of the roller carrier 40, so as to bias the roller carrier 40 to an outwardly extending position. One or more barbs 45 extend from each flange 42 and are engageable with the housing 22, to slide within grooves 46 and limit the downward travel of the roller carrier 40 within the housing 22. One or more openings 47 are defied within the side wall of each flange 42 so as to be engageable by the projections 30 so as to retain the roller carrier 40 in a compressed position for shipping purposes with the roller substantially protected within the housing 22.

A base plate 50 is disposed within the cavity 26 and is adopted to be adjusted vertically with respect to the housing 22. The base plate 50 defines an aperture 52 through which the coil springs 44 pass. A rack member 54, also referred to as an adjustment dog, is connected to the base plate 50. In the preferred embodiment the base plate 50 and the rack member 54 are molded as an integral unit. The rack member 54 is provided with a plurality of teeth 56. An adjustment gear 58 is provided with a plurality of gear teeth 60 which are adapted to engage and cooperate with the teeth 56 on the rack member 54 to thereby raise or lower the base plate 50 vertically with respect to the housing 22. The adjustment gear 58 extends laterally through an aperture 62 provided in each of the side walls 24 A and B, such that the end of the adjustment gear 58 lies generally flush with the outer surface of the side walls 24 A and B. A slot 64, in the nature of an engagement means, is provided in at least one end of the adjustment gear 58 to enable it to be easily rotated and adjusted from outside the door frame 14. The slot 64 can accept the end of a screwdriver blade. Alternatively, an engagement means in the form of a thumb screw (not shown) or other profile may be extended from the face of the gear 58 for engagement and rotation thereof. One or more flexible locking fingers 65 are shown extending from the housing 22 to engage the adjustment gear teeth 60 and selectively restrain the gear 58 against rotation until sufficient force is exerted to override the restraining influence of the fingers 65.

A roller 66, defining an integral hub 68, is rotatably supported between the lower ends of the roller carrier flanges 42. The outer periphery of the roller 66 defines a substantially U-shaped groove 70 which fits over the rail 72 provided on the track 16 over which the door frame 14 slides.

The installation of the adjustable roller assembly 10 in the door frame is accomplished by inserting the hook-notch end 38 of the housing 22 into one end of the door frame slot and rotating the housing 22 upwardly. Because of the diverging slant of the locking member 34, the upper portion of the locking member 34 contacts the second end of the door frame slot and is biased inwardly toward the sides of the housing 22 as the roller assembly 10 is rotated upwardly through the door frame slot until the free end of the locking member 34 passes therethrough. At that point, the locking member 34 springs outwardly, trapping the flat surface of the door frame edge between the locking member 34 and the flange 32, such that the abutment surface 36 of the locking member 34 contacts the upper surface 74 of the door frame edge and the upper surface of the flange 32 is disposed adjacent and in contact with the lower surface 33 of the door frame edge. When the roller assembly 10 is thus inserted, the sides 24 A and B of the housing 22 contact the ends of the door frame slot and prevent lateral movement of the assembly 10 within the slot. No tools are necessary for installation. For removal of the roller assembly 10, a notch can be provided in the door frame slot for insertion of an implement or tool that is used to press the locking member 34 inwardly to effect removal, as shown in U.S. Pat. No. 4,850,078.

The base plate 50 may be adjusted vertically with respect to the housing 22 and door frame 14 from one or both sides of the door frame 14 after installation. The end of a screwdriver or other engagement tool is positioned in the slot 64 at the end of the adjustment gear 58 and rotated one way or the other depending on whether it is desired to raise or lower the base plate 50. When the adjustment gear 58 is rotated, the gear teeth 60 in engagement with the teeth 56 on the rack member 54 act to vertically raise or lower the rack member 54 with respect to the housing 22, depending upon the direction of rotation of the adjustment gear 58. Since the base plate 50 is connected to the rack member 54, the base plate 50 is also vertically raised and lowered, respectively.

The base plate 50 acts as a stop to limit the upper vertical movement of the roller carrier 40 and roller 66. Although the roller carrier 40 and roller 66 are biased outwardly by the coil springs 44, the weight of the door frame 14 will greatly reduce this biasing force, and may eventually overcome it through wear and tear on the springs 44. The vertical adjustment of the base plate 50 greatly increases the load-carrying capacity of the roller 66, allowing for the roller 66 to maintain firm engagement with the track 16. The roller assembly 10 may be adjusted to take up the slack between the door frame 14 and the track 16 or to tighten the fit therebetween by lowering the base plate 50, and consequently the roller carrier 40 and roller 66. In its lowermost position, as seen in FIG. 1, the base plate 50 is located so as to virtually eliminate any travel of the roller carrier 40 and roller 66 after the door frame 14 is installed on the track 16. This acts to keep the door frame 14 on the track 16 and prevent derailing. The roller carrier 40 and roller 66 are biased outwardly by both the base plate 50 and the force of the coil springs 44. Conversely, the roller assembly 10 may be adjusted to increase the slack or loosen the fit therebetween by raising the roller 66. In its uppermost position, as seen in FIG. 2, the base plate 50 allows for maximum vertical travel of the roller carrier 40 and roller 66 which allows for installation of the door frame 14 over the track 16.

While the above description describes a roller assembly which is installed in the lower edge of a door, it is understood that the roller assembly may also be installed in the upper edge of a door as well. Thus it has been shown that the present invention provides for an easily adjustable roller assembly for sliding doors which may be installed without tools.

Various features of this invention have been particularly shown and described in connection with the illustrated embodiment of the invention. However, it must be understood that these particular arrangements merely illustrate, and that the invention is to be given its fullest interpretation within the terms of the appended claims.

What is claimed is:

1. An adjustable roller assembly for sliding doors including a housing adapted to be mounted in a recess in a door frame, said housing defining a cavity therein and having an opening at the lower end thereof; a roller carrier positioned within said cavity and movable vertically with respect to said housing; a roller member rotatably mounted in said roller carrier; resilient biasing means disposed in said housing adapted to engage said roller carrier so as to bias said roller carrier and roller to an extended position; a base plate disposed within said housing and vertically adjustable with respect thereto between a lower position and an upper position; adjustment means associated with said base plate for effecting vertical adjustment of said base plate with respect to said housing such that the position of said base plate acts as a stop to limit the upward travel of said roller carrier, whereby when said base plate is adjusted to its uppermost position, said roller carrier is permitted maximum vertical travel, but when said base plate is adjusted to its lowermost position said roller carrier is permitted minimum travel.

2. The adjustable roller assembly of claim 1 in which said adjustment means includes a rotatable gear mounted in said housing and associated with said base plate so as to vertically and selectively adjust the position thereof.

3. The adjustable roller assembly of claim 2 in which said adjustment means further includes a rack member associated with said base plate and engageable by said rotatable gear such that rotation of said gear causes vertical movement of said rack member and said connected base plate to limit the upward travel of said roller carrier to thereby adjust the slack between said roller and the surface on which it slides.

4. The adjustable roller assembly of claim 3 further including a plurality of teeth on the outer periphery of said gear and a plurality of teeth on said rack member.

5. The adjustable roller assembly of claim 2 including one or more locking fingers adapted to engage said gear and restrain rotation thereof.

6. The adjustable roller assembly of claim 2 in which said gear is provided with engagement means so as to enable selective rotation thereof.

7. The adjustable roller assembly of claim I including a position locking means associated with said housing and said roller carrier for selectively retaining the roller carrier in a vertically upward position whereby said roller member is substantially concealed with said housing.

8. The adjustable roller assembly of claim 7 in which said position locking means includes one or more projections extending inwardly from said housing and one or more apertures formed in said roller carrier, said apertures positioned so as to receive said projections from said housing, thereby locking said roller carrier in the vertically upward position.

9. The adjustable roller assembly of claim I in which said roller carrier includes one or more outwardly extending barbs engageable with said housing , so as to limit the downward travel of said roller carrier with respect to said housing to retain said roller carrier within said housing.

10. The adjustable roller assembly of claim 9 including one or more slots defined in said housing adopted to receive said barbs and guide the movement thereof.

11. The adjustable roller assembly of claim I in which said roller defines a groove around the outer periphery thereof adapted to receive a rail of a track.

12. The adjustable roller assembly of claim I in which said resilient biasing means consists of one or more coil springs disposed between said housing and said roller carrier.

13. The adjustable roller assembly of claim 1 in which the base plate defines an opening through which said resilient biasing means extend so as to enable said resilient biasing means to engage said roller carrier.

14. The adjustable roller assembly of claim I including locking means associated with said housing for securing said housing in the recess of a door frame.

* * * * *